United States Patent [19]

Saiya

[11] 4,346,501

[45] Aug. 31, 1982

[54] HEADSET CABLE STRAIN RELIEF CLAMP

[76] Inventor: Robert F. Saiya, 770 Park Ave., Huntington, N.Y. 11743

[21] Appl. No.: 151,917

[22] Filed: May 21, 1980

[51] Int. Cl.[3] ..... A44B 21/00

[52] U.S. Cl. ..... 24/329; 248/226.5; 24/337

[58] Field of Search ..... 24/326, 327, 329, 333, 24/337, 335, 336, 73 SA, 73 AP, 81 H, 81 R, 81 NH, 817 H; 248/63, 316 B, 226.5, 229, 230

[56] References Cited

U.S. PATENT DOCUMENTS

| | | | |
|---|---|---|---|
| 2,171,665 | 9/1939 | Meltzer | 24/337 X |
| 3,111,296 | 11/1963 | Ludes | 248/226.5 X |
| 3,422,391 | 1/1969 | Thomson | 24/329 X |
| 3,772,734 | 11/1973 | Kimel | 24/326 X |
| 4,010,879 | 3/1977 | George et al. | 24/336 X |
| 4,197,945 | 4/1980 | Sherwood | 24/336 X |

*Primary Examiner*—Roy D. Frazier
*Assistant Examiner*—Peter A. Aschenbrenner
*Attorney, Agent, or Firm*—Wolder, Gross & Yavner

[57] ABSTRACT

A strain relief clamp for supporting the signal cable dependent from a communications headset. A unitary, integrally molded plastic structure is provided having a pair of toothed jaws joined by a hingeless support member and lever actuated to effect a secure clamp action on the wearer's apparel. A pair of yieldable clamp arms with a cooperating clamp retainer ring are provided to adjustably position and secure the signal cable to the unitary strain relief clamp.

4 Claims, 4 Drawing Figures

HEADSET CABLE STRAIN RELIEF CLAMP

TECHNICAL FIELD

This invention relates to strain relief clamps for supporting a cable used with a microphone or communications headset by removably clamping the supported cable to the user's wearing apparel.

BACKGROUND ART

Earphone and combination earphone and microphone headsets have long been provided for use in the communications field. Over extended periods of use of such devices, the weight of the signal carrying cable pulling downwardly against the user's head and ears can cause the headset to fly off the user's head and can create general discomfort. If the cable is permitted to swing freely with movement of the user's head, the discomfort and physical annoyance is further aggravated.

Various types of cable attached clip devices have been proposed in the prior art for relieving such cable imposed strain most of which have either been overly complex and expensive to manufacture or have lacked cable adjustment flexibility. One example of a prior art cable strain relief device which is relatively heavy, complex and expensive to manufacture is disclosed in U.S. Pat. No. 3,604,069. In the aforementioned structure, a spring loaded clothing clip is combined with a separate spring loaded plunger for adjustably securing the cable to the clip.

It is a principal object of the present invention to provide an integral low cost, lightweight, secure and simple-to-operate cable strain relief clamp which can be readily adjusted to afford optimum operator comfort.

DISCLOSURE OF THE INVENTION

The present invention provides a unitary cable strain relief clamp integrally molded of a resilient plastic and having disposed at one end a hingeless lever operated pair of toothed clamp jaws for securing the device to the user's wearing apparel and at the opposite end thereof a pair of spaced clamp arms with a cooperating removable clamp closure ring defining an adjustable cable retention slot. The clamp structure is molded as a single unitary device using a strong resilient plastic material such as nylon, polyacetal (e.g., DELRIN) or the like. Since there are no component parts to assemble, manufacturing cost is minimized.

BEST MODE FOR CARRYING OUT THE INVENTION

Figure 1:
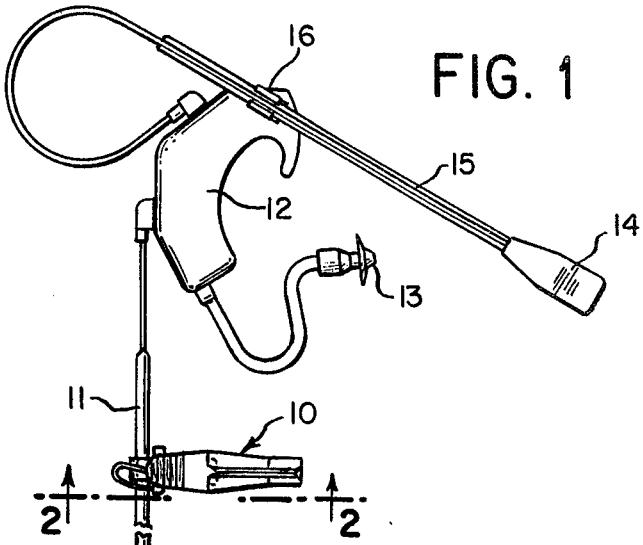
FIG. 1 is a side elevation view of an ear supported headpiece with an attached signal cable and cable strain relief clamp secured thereto.

Referring to the drawings and particularly to FIG. 1, there is shown a cable strain relief clamp 10 secured to signal cable 11 plunged into and dependent from the ear supported housing 12 for the signal amplifiers for earpiece 13 and microphone 14. As shown microphone 14 is supported by boom 15 which is both slideably and rotatably secured to housing 12 by clamp 16.

Figure 2:
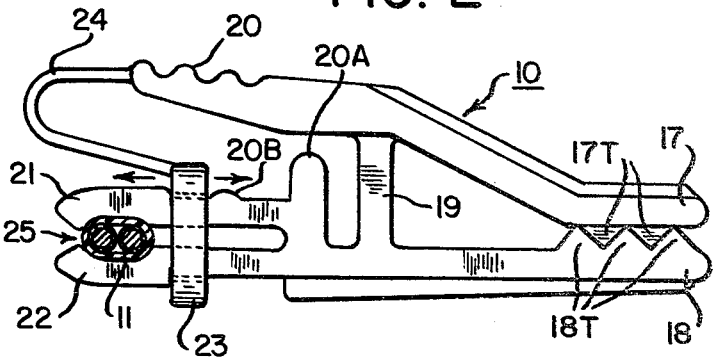
FIG. 2 is an enlarged side elevation view of the cable strain relief clamp provided in accordance with the invention.
Figure 4:
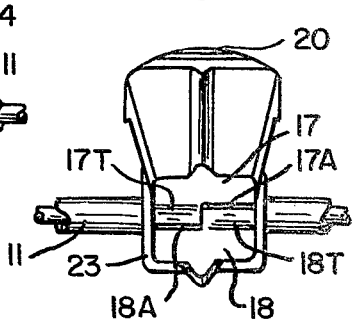
FIG. 4 is a view of FIG. 2 as viewed from the apparel clamp end.

A preferred operative embodiment of the cable strain relief clamp is shown in greater detail in FIG. 2. The entire clamp structure 10 is preferably molded as a complete unitary structure utilizing a strong and relatively springy plastic material such as nylon or polyacetal (e.g., DELRIN). The apparel clamp portion comprises opposing jaws 17 and 18 with molded apparel holding teeth 17T and 18T laterally offset to afford a secure grip on the wearer's apparel. In the preferred embodiment, the teeth 17T and 18T are half the width of each of the respective supporting jaws 17 and 18 and offset as shown in FIG. 4. The upper set of teeth 17T contact an opposing flat surface 18A on jaw 18 and the lower set of teeth 18T contact an opposing flat surface 17T on jaw 17. The stair-step like offset between the cooperating jaw teeth affords an extremely firm and stable grip on the wearer's apparel.

Jaw members 17 and 18 are joined by a hingegless spring member 19 which bends when hand pressure is applied on lever arm extension handle 20 thereby causing the jaws to open for application to the wearer's apparel. When pressure on 20 is relaxed, the toothed jaws 17 and 18 are brought into firm engagement by spring member 19. Extension arm 20A is provided as a stop to limit the downward travel of handle 20.

Figure 3:
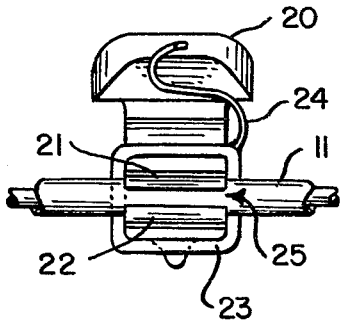
FIG. 3 is a view of FIG. 2 as viewed from the cable clamp end.

The preferred cable clamp portion of 10 comprises spaced clamp arms 21 and 22 and clamp arm retainer ring 23 tethered to the end of handle 20 by strap member 24. With retainer ring 23 moved inwardly over retaining lug 20B and away from yieldable clamp arms 21 and 22, cable 11 may be readily removed or inserted through the arm separation slot 25. After cable 11 is seated in its retainer slot as shown in FIGS. 2 and 3, the unitary strain relief clamp 10 is rotatably and/or slidably positioned lengthwise along cable 11 to meet the user's comfort and wearing apparel requirements and clamp retainer ring 23 is thereafter moved outwardly over 20B into its retaining position as shown in FIG. 2 causing arms 21 and 22 to bend inwardly and firmly secure strain relief clamp 10 to a desired holding position on cable 11.

It will be apparent to those skilled in the art that the cable strain relief clamp disclosed herein provides a highly desirable lightweight, low cost, simple-to-operate, reliable structure having a long operating life.

I claim:

1. A strain relief clamp for adjustably securing to a user's wearing apparel a signal cable dependent from a communications headset, said clamp including a unitary integrally molded plastic structure having a pair of toothed jaws joined by a hingeless jaw closure support member, one of said jaws including a lever arm extension for manually opening said jaws to adjustably clamp secure the strain relief clamp to the user's wearing apparel; said integrally molded plastic structure further including a pair of spaced yieldable clamp arms defining a retainer slot for receiving and adjustably clamp securing the unitary strain relief clamp to the signal cable, each of said toothed jaws having a set of apparel gripping teeth aligned in a row, each of said rows being spaced from the row of the opposing jaw, the teeth of said rows being so constructed and oriented along said rows as to be non-overlapping with respect to the row of teeth of the opposing jaw.

2. The apparatus of claim 1 further including a plastic clamp retainer ring oriented with respect to said yieldable clamp arms to tightly encircle said clamp arms and thereby provide an increased clamp pressure on the signal cable, and strap means connecting said retainer ring to said unitary plastic structure.

3. The invention of claim 1 or 2 further characterizing that the unitary strain relief clamp is integrally molded of polyamide plastic.

4. The invention of claim 1 or 2 further characterized in that the unitary strain relief clamp is integrally molded of a polyacetal plastic.

* * * * *